United States Patent [19]

Sumner et al.

[11] Patent Number: 4,776,765

[45] Date of Patent: Oct. 11, 1988

[54] MEANS AND METHOD FOR REDUCING SOLID PARTICLE EROSION IN TURBINES

[75] Inventors: William J. Sumner, Mechanicville; James H. Vogan; Robert J. Lindinger, both of Schenectady, all of N.Y.

[73] Assignee: General Electric Company, Schenectady, N.Y.

[21] Appl. No.: 760,214

[22] Filed: Jul. 29, 1985

[51] Int. Cl.[4] ..... F01D 5/14

[52] U.S. Cl. ..... 416/241 R; 415/181

[58] Field of Search ..... 415/181, 216, 217, 212 A, 415/196, 197, 174, 200; 416/241 R, 224

[56] References Cited

U.S. PATENT DOCUMENTS

| | | | |
|---|---|---|---|
| 994,029 | 5/1911 | Parsons | 415/196 |
| 1,364,197 | 1/1921 | Heath | 416/224 |
| 1,504,736 | 8/1924 | Brown | 415/200 |
| 2,520,373 | 8/1950 | Price | 415/200 |
| 2,680,286 | 6/1954 | Willgoos | 415/212 A |
| 2,920,007 | 1/1960 | Buckland | 415/212 A |
| 3,114,961 | 12/1963 | Chambers et al. | 416/241 R |
| 4,492,522 | 1/1985 | Rossmann et al. | 416/241 R |
| 4,563,801 | 1/1986 | Schill et al. | 416/241 R |

FOREIGN PATENT DOCUMENTS

| | | | |
|---|---|---|---|
| 100283 | 7/1923 | Switzerland | 415/212 A |
| 615240 | 7/1978 | U.S.S.R. | 416/224 |
| 3034452 | 12/1928 | United Kingdom | 416/224 |
| 381102 | 9/1932 | United Kingdom | 416/224 |
| 636084 | 4/1950 | United Kingdom | 416/224 |

OTHER PUBLICATIONS

"Reducing Solid Particle Erosion Damage in Large Steam Turbines" W. J. Sumner, J. H. Vogan, R. J. Lindinger. Presented at American Power Conference, Apr. 22-24, 1985, Chicago, Ill.

"Recent Advances in Improving Turbine-Generator Availability and Performance"-R. C. Spencer, Presented at 12th Energy Technology Conference and Exposition, Mar. 25-27, Washington, D.C.

*Primary Examiner*—Robert E. Garrett
*Assistant Examiner*—John T. Kwon
*Attorney, Agent, or Firm*—Jerome C. Squillaro

[57] ABSTRACT

Applicants have identified and unexpected mechanism which contributes to solid particle erosion of the trailing edge of spaced apart aerodynamically shaped nozzle partitions in an axial fluid flow turbine. Particles entrained in the fluid flow pass through passages between nozzle partitions, strike rotating buckets and rebound upstream to impinge upon the suction side of the nozzle partitions in the trailing edge region. Accordingly, a nozzle partition includes a protection device disposed over at least a portion of the suction side of the nozzle partition, preferably from the trailing edge to the throat, for preventing solid particle erosion of the partition.

22 Claims, 2 Drawing Sheets

MEANS AND METHOD FOR REDUCING SOLID PARTICLE EROSION IN TURBINES

BACKGROUND OF THE INVENTION

This invention relates to reducing solid particle erosion (hereinafter SPE) in axial flow fluid turbines, such as steam turbines, and more particularly, to reducing erosion of the trailing, or downstream, edge of stationary spaced apart nozzle partitions, which are used to define passageways, or nozzles, therebetween for directing steam flow into a rotatable plurality of turbine blades.

In general, steam turbines operate to convert energy stored in high pressure, high temperature steam, such as may be obtained from an external boiler, into rotational mechanical movement. Steam turbines employed by electric utilities as a prime mover for electrical generators to produce electric power, typically comprise a plurality of turbine blades, or buckets, radially extending and circumferentially mounted on the periphery of a rotor shaft to form a turbine wheel. Generally, the steam turbine includes a plurality of axially spaced apart bucket wheels. The rotor shaft, with associated bucket wheels, is mounted on bearings with the bucket wheels disposed inside an inner shell which may be in turn surrounded by a spaced apart outer shell. This double shell configuration forms a pressurizable housing in which bucket wheels rotate and prevents potentially damaging thermal gradients.

The bucket wheels are disposed between corresponding stationary nozzle diaphragms which are formed by an array of stationary aerodynamically configured partitions substantially radially disposed between and fixedly retained by a pair of concentric diaphragm rings, which circumferentially surround the rotor. These partitions are typically referred to as nozzle partitions and the spaces between the partitions as nozzles. As steam flows through the interior cavity of the pressurizable inner shell, it passes through and coacts with alternately disposed stationary nozzle partitions and rotatable turbine bucket wheels to produce rotational movement of the rotor shaft. The combination of a pair of diaphragm rings with their associated partitions and the cooperating row of downstream buckets is generally referred to as a stage, stages being numbered sequentially in the direction of steam flow, starting from the steam input region. These concepts are elementary and are generally well known in the turbine art.

Modern large steam turbines generally comprise several sections such as, for example, high-pressure (HP), intermediate pressure (IP) and low-pressure (LP), which may be mechanically coupled to drive an electrical generator. Of course other turbine configurations are possible, such as a double reheat turbine which includes a high-pressure, first reheat (IP), second reheat ("low pressure" IP) and low pressure sections. Generally the reheat portion of a turbine is defined to include all intermediate and low pressure sections, i.e. from the outlet of a steam reheater coupled between the high-pressure and first intermediate-pressure section to the input of a condenser for condensing steam before recycling the water formed back to the steam generator. These sections possess various design characteristics so as to permit extraction of the optimum amount of energy from the expansion of steam through the respective turbine sections, thereby optimizing overall turbine efficiency. It is common practice to have one or more of these sections configured in a double flow arrangement, in which steam entering a middle portion, or tub, of the section encounters a diverging flow path. After entry into this middle portion of one of the turbine sections, steam exits in substantially opposite directions, wherein the oppositely directed steam flows are used to impart rotation in the same direction to the turbine shaft. This double flow configuration beneficially contributes to overall machine efficiency. However, the present invention is applicable to all generally axial flow fluid turbines, regardless of steam flow path diversions.

In a system configured so that steam flows from a boiler to a high pressure turbine and then successively to an intermediate pressure and low pressure turbine, it has been noted that the trailing edge portion of nozzle partitions, especially those of the first stage of the reheat portion, are subject to SPE. SPE is believed to be caused by exfoliation of an oxide film, which is primarily magnetite ($Fe_3O_4$), from the steam side of boiler tubes and steam conduit. Until detailed investigation by applicants identified the actual mechanism of SPE of trailing edges of nozzle partitions in the first stage of the reheat section of the turbine, it was believed that SPE was caused by direct impact on the pressure side of nozzle partitions by contaminating particles entrained in the steam flow. However, applicants surprisingly have discovered that the velocity of particles entrained in the steam flow through nozzles was relatively constant, and not substantially affected by the rapidly increasing steam velocity as it approached the throat region (i.e. minimum flow area between adjacent nozzle partitions) of the nozzle. Further, the vast majority of particles were found to be impacting the trailing edge region of the pressure surface of a nozzle partition at a relatively steep angle in contrast to relatively shallow angles that are required to produce maximum rates of SPE. In addition, it was noted that particles impacting the pressure side lost momentum and therefore approached buckets at an angle and velocity that are conducive to producing rebound, after collision with buckets, back upstream against the generally axial flow of steam to strike the suction surface of partitions.

Continuous operation of a turbine in an environment conducive to SPE may eventually result in loss of metal along the trailing edge portion of nozzle partitions, whereby the designed airfoil configuration of partitions is altered. This results in reduced stage, and thereby overall turbine, efficiency. SPE may also be a factor contributing to forced outages, extended maintenance outages, shortened planned inspection intervals and increased maintenance costs, all of which adversely affect economical operation of the turbine.

In order to remove the suspected source of the SPE problem for turbines, work has progressed on reducing undesirable material supplied with steam to the turbine from boilers. However, it is still desirable to find a solution to the problem of SPE at the turbine, since it is expensive to replace entire tubes or rework the steam side of boiler tubes of existing boilers, and even with such modifications, boilers may still experience some exfoliation.

Using sophisticated computer modelling techniques to model steam flow through turbine sections, applicants have discovered an unexpected mechanism of SPE which is particularly functional in the first stage of the reheat section and other stages where the steam pressure level is relatively low as compared with the input steam pressure level to the first stage of the high pressure section. They have found that a major component of the mechanism for SPE of trailing edges of nozzle partitions, especially for the first stage of a reheat section of a turbine, includes particles exiting nozzle passages of the first stage and striking the leading edge portion of the associated downstream rotating buckets of the first stage. After striking the buckets, the particles rebound off the buckets and strike the suction surface of first stage nozzle partitions with sufficient velocity and at an appropriate angle to cause SPE of the nozzle partitions. Thus, contrary to prior belief, the primary cause of SPE of the trailing edge of reheat first stage nozzle partitions has been determined by applicants to be particulate impingement on the suction side of the trailing edge portion of nozzle partitions from a direction opposing steam flow through the turbine stage.

Accordingly, it is an object of the present invention to prevent solid particle erosion of the trailing edge portion of nozzle partitions by particles impinging the trailing edge portion on the suction side of nozzle partitions.

Another object of the present invention is to prevent solid particle erosion of the endwall of a diaphragm ring.

SUMMARY OF THE INVENTION

In accordance with the present invention, a nozzle partition for an axial flow fluid turbine includes protection means disposed over at least a portion of the suction side of the nozzle partition, preferably from the trailing edge to the throat, for preventing solid particle erosion of the partition.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
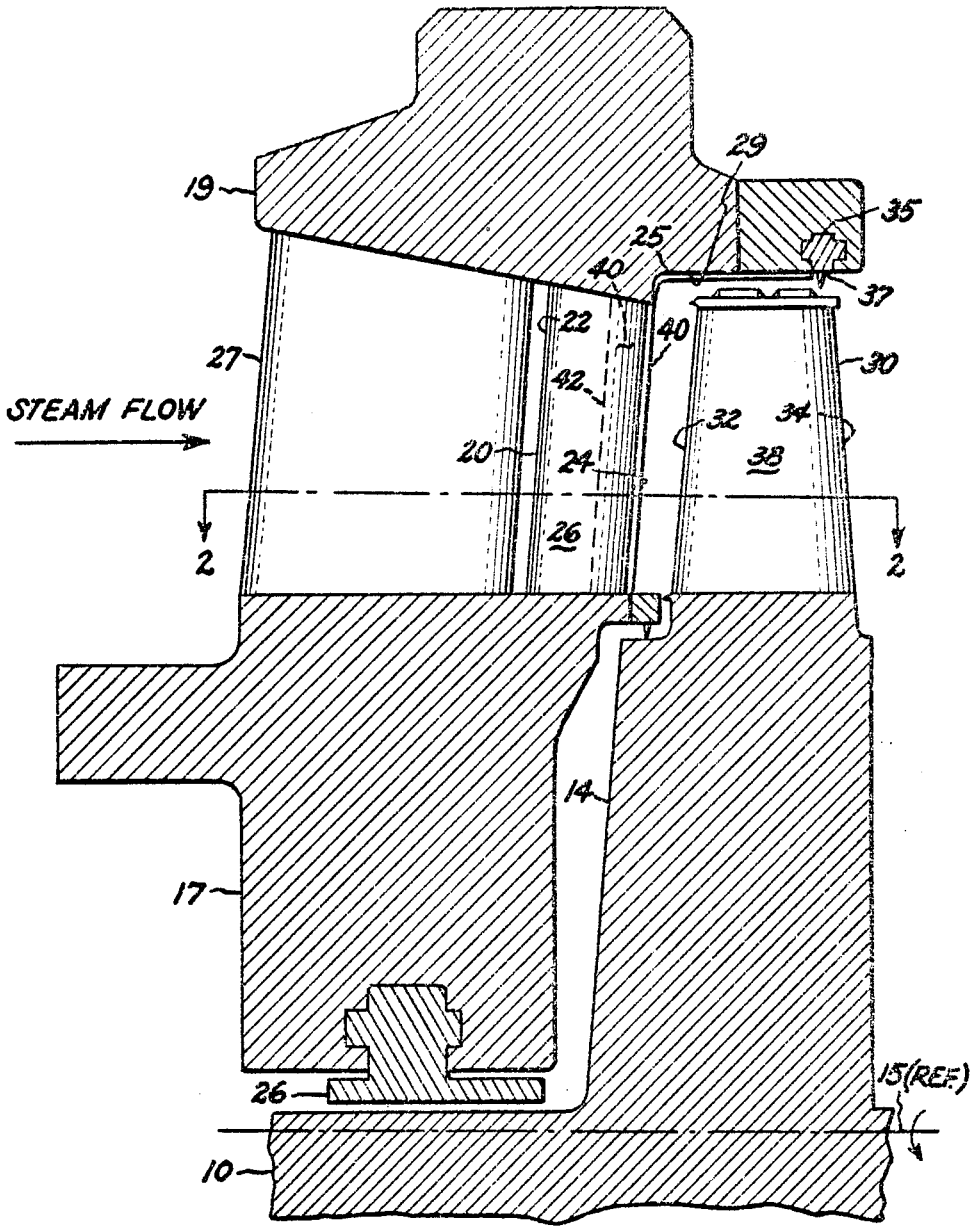
FIG. 1 is an elevational view of a first stage of a reheat turbine in accordance with the present invention.

Referring to FIG. 1, the first stage of an axial flow reheat steam turbine is shown. It is to be understood that the stage shown in FIG. 1 is only representative, and that the present invention is applicable to any axial flow fluid turbine. The stage comprises a plurality of nozzle partitions 20, generally radially disposed between inner diaphragm ring, or web, 17 and outer diaphragm ring 19 which circumferentially surround rotor 10, and a plurality of turbine blades, or buckets, 30 fixedly secured to and rotatable with rotor 10 having an axis of rotation 15. Axis of rotation 15 is shown for reference as parallel to the true axis of rotation which is generally disposed at the center of rotor 10. As shown in FIG. 1, buckets 30 may be fixedly secured to a wheel 14 which may be a radially extending portion of rotor 10. Seal means 26, such as a labyrinth seal, for minimizing steam leakage is disposed between the radially inner portion of inner diaphragm ring 17 and the periphery of rotor 10. Erosion blocking means 25, such as a layer of coating material, for preventing solid particle erosion is circumferentially disposed over endwall 29 of outer diaphragm ring 19 and axially extends between trailing edge 24 of partition 20 and a bucket tip spill strip groove 35 having a spill strip 37 disposed therein. It is to be understood that typically a turbine section comprises a plurality of stages which mutually cooperate to extract energy from steam. Bridging partition 27 is disposed upstream nozzle partition 20 and radially extends between inner diaphragm ring 17 and outer diaphragm ring 19 for supporting and maintaining inner diaphragm ring 17 concentric with respect to outer diaphragm ring 19. Outer diaphragm ring 19 is generally secured to an inner wall of a casing or housing (not shown). A plurality of bridging partitions are uniformly circumferentially spaced around rotor 10.

Figure 2:
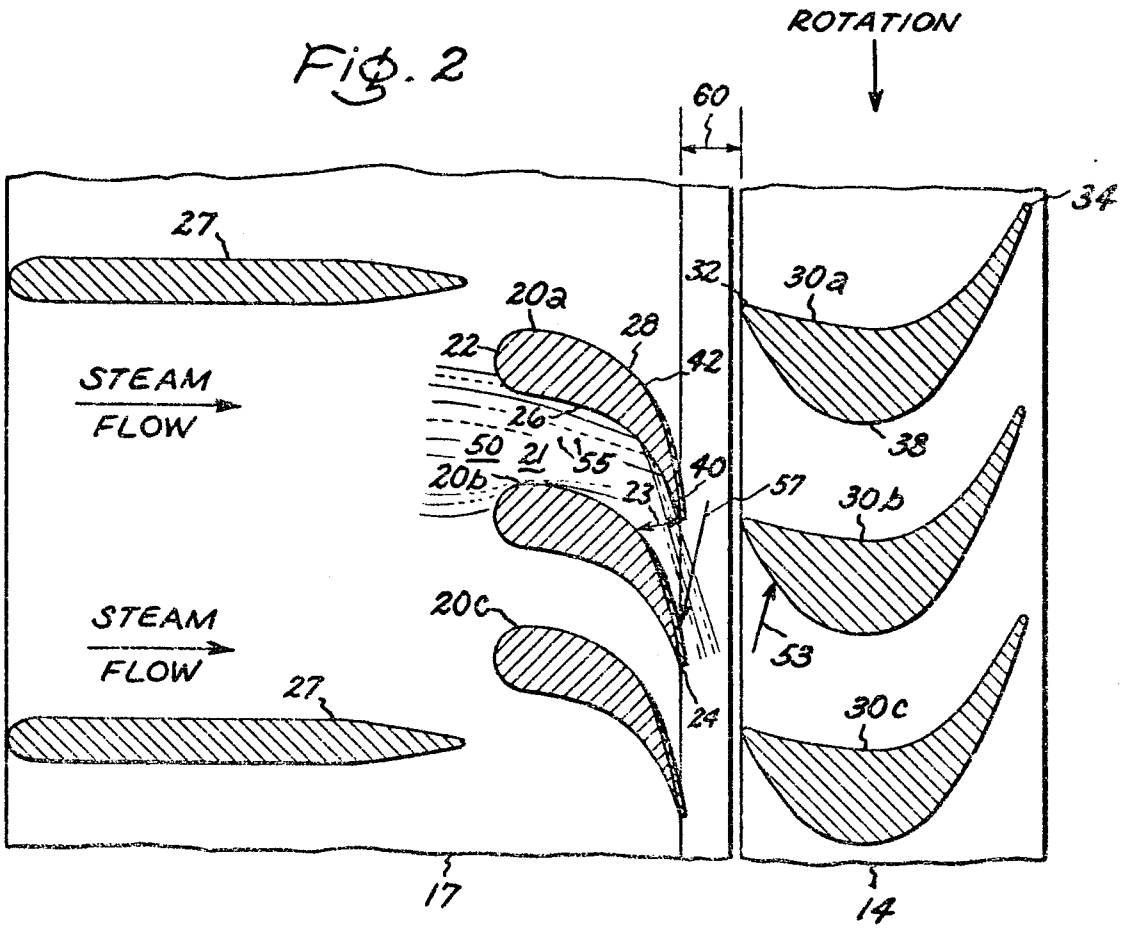
FIG. 2 is a view taken along line 2—2 of FIG. 1.

Referring to FIG. 2, a view looking in the direction of the arrows of line 2—2 is shown. Three nozzle partitions **20*a*, 20*b* and 20*c* of the plurality of nozzle partitions 20 (FIG. 1) are shown for ease of illustration. It is to be understood that the plurality of nozzle partitions 20 generally uniformly circumferentially surround rotor 10 (FIG. 1) of the turbine section. Likewise, three of the plurality of turbine buckets 30 (FIG. 1) are shown. It is also to be understood that turbine buckets 30 generally uniformly circumferentially surround rotor 10**.

For ease of explanation and to avoid undue repetition, only a single nozzle partition **20*a* and a single turbine bucket 30*a* will be described in detail, it being understood that the remaining nozzle partitions of the plurality of nozzle partitions 20 and the remaining turbine blades of the plurality of turbine blades 30** may be respectively similarly fabricated.

Nozzle partition **20*a* comprises a leading edge 22 and an aerodynamically shaped pressure surface or side 26 that extends from leading edge 22 and intersects an aerodynamically shaped suction surface or side 28, which extends from leading edge 22, at a trailing edge 24 of nozzle partition 20*a*. Nozzle partition 20*a* is spaced from nozzle partition 20*b* to form a passageway, or nozzle, 21 therebetween. The smallest flow area, or throat, of passageway 21 as referenced from trailing edge 24 of partition 20*a* is indicated by line 23, which extends between trailing edge 24 of nozzle partition 20*a* and a point 42 (indicative of line 42 as shown in FIG. 1) on the suction surface of nozzle partition 20*b*. Thus, fluid flow entering passageway 21 converges and accelerates until it reaches throat 23 and then diverges downstream throat 23. Turbine blade 30*a* comprises a leading edge 32, an aerodynamically configured pressure side 36 that extends from leading edge 32 to intersect an aerodynamically configured suction side 38, which extends from leading edge 32, at a trailing edge 34 of bucket 30*a***.

Protection means 40, such as a sheet or coating of metal having a greater resistance to SPE than the metal forming nozzle partition **20*a*, extends over at least a portion of suction side 28 of nozzle partition 20*a*. Although protection means 40 may entirely extend over suction side 28, it is preferable that protection means 40 have a smooth outer surface in order to maintain aerodynamic flow and gradually taper in thickness from trailing edge 24 to terminate at throat point 42 so that protection means 40 does not interfere with the aerodynamic configuration of nozzle 21 upstream of throat 23**.

Protection means 40 may comprise any material that is resistant to SPE such as may be expected to be experienced in the turbine and that is compatible with the substrate composition of nozzle partition **20*a*. For example, typically the martensitic family of 12% chromium stainless steel is used as the construction material for steam path components of a steam turbine. When protection means 40 includes a coating, it may be applied at least over a portion of suction side 28 of nozzle partition 20***a* by processes such as plasma spraying and diffusion coating. Although any material having an erosion resistance greater than the material forming nozzle partition 20*a* may be used for protection means 40, a tungsten carbide or chromium carbide based material, such as is typically used to coat the pressure side of nozzle partitions, may be used. Alternatively, protection means 40 may include a sheet of material having a resistance to SPE which is greater than the SPE resistance of the material constituting nozzle partition 20*a*. The sheet of material may be secured, such as by welding, over the desired portion of suction side 28 of partition 20*a*. A portion of the material of suction side 28 of partition 20*a* may be removed before applying the sheet of material to permit more SPE resistant material to be used, while still substantially maintaining the aerodynamic profile of suction side 28.

One method for applying protection means 40 as a diffusion coating involves a pack cementation process in which the part, e.g. partition 20, to be coated is packed in a mixture which includes an inert powder, a source of the element to be diffused into the surface and an activator, such as a halide salt. The packed component is subjected to a temperature from about 1650° F. to about 2000° F. for several hours and then cooled for subsequent removal of the pack. The cooling rate from the pack diffusion temperature is relatively slow and makes it necessary to heat treat the part to obtain the desired mechanical properties.

In order to avoid potential problems caused by excessive heating of existing turbine parts during retrofit of turbine components in accordance with the present invention, inner and outer diaphragm ring 17 and 19 (FIG. 1) may be fabricated as two 180° segments having a plurality of nozzle partitions 20 spaced therebetween. Existing inner and outer diaphragm rings and nozzle partitions may be removed and inner and outer diaphragm ring 17 and 19 and nozzle partitions 20, including desired protection means 40, may be welded in place in the turbine steam flow path.

Also shown in FIG. 2, is a typical predicted trajectory pattern 50, as determined by applicants, of particles 55 entrained in fluid flow entering nozzle 21 and between partitions 20*a* and 20*b*. Particle flow after exiting nozzle 21 is shown schematically by arrows 53 and 57 due to relative motion between buckets 30 and partitions 20 when the turbine is operating. It is to be understood that trajectory pattern 50 may vary in accordance with operating conditions, such as load on the turbine, particle size, fluid density, and fluid path geometry, and that some particles 55 will eventually enter all nozzles 21 between nozzle partitions 20. Some particles 55 impact in the region of leading edge 22 of partitions 20*a* and 20*b* and most particles 55 ultimately impact pressure surface 26 of partition 20*a* due to the inability of particles 55 to negotiate the turn necessary to exit nozzle 21 without first striking surface 26. Particles 55 impact pressure side 26 in the region near trailing edge 24 at a relatively low velocity and steep angle, which minimizes SPE, in relation to a relatively high velocity and shallow angle of impact that are required to produce a maximum rate of SPE.

After passing through nozzle 21, particles 55 impact suction side 38 of bucket 30*b* from a direction indicated by arrow 53 relative to rotating buckets 30 and rebound upstream in a direction indicated by arrow 57 relative to partition 20*b* to strike protection means 40 of suction side 28 of nozzle partition 20*b*. It must be remembered that during turbine operation buckets 30 are rotating and thus particles from nozzle 21 may strike suction surface 38 of bucket 30*a* or some other bucket 30 and rebound to strike surface 40 of partition 20*b* or another partition 20 further circumferentially displaced in the direction of rotation of buckets 30 from partition 20*b*. However, since partitions 20 and buckets 30 generally uniformly surround rotor 10 (FIG. 1) and further since fluid may be generally uniformly circumferentially introduced into the region upstream from partitions 20, each nozzle 21 will generally have particles 55 flowing therethrough and thus each protection means 40 of suction surface 28 will have particles 55 impinging thereon from a direction axially downstream. The actual bucket which is struck by particles 55 exiting nozzle 21 will depend on the axial velocity component of particles 55, angular velocity of buckets 30 and the spatial relationship between partition 20*a* and bucket 30*a* at the time particles 55 exit from nozzle 21. Accordingly, another way for reducing the effects of SPE generated by the mechanism of particle 55 rebound as identified by applicants is to increase the axial spacing 60 between nozzle partitions 20 and associated buckets 30 of a stage, since this will reduce the momentum of rebounding particles 55 that strike nozzle partitions 20. Increasing the axial dimension between nozzle partitions 20 and buckets 30 may be used alone or in combination with protection means 40.

Thus has been illustrated and described means for preventing solid particle erosion of the trailing edge portion of nozzle partitions by particles impinging the trailing edge portion on the suction side of the partitions and for preventing solid particle erosion of the endwall of a diaphragm ring.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A nozzle partition for a steam turbine, said nozzle partition having an aerodynamically shaped suction surface and including protection means disposed only on the suction surface and extending over at least a portion of the suction surface for preventing solid particle erosion of said nozzle partition.

2. The nozzle partition as in claim 1, further having an aerodynamically shaped pressure surface, said pressure surface intersecting said suction surface at a trailing edge, wherein the protection means is disposed up to said trailing edge.

3. The nozzle partition as in claim 2, wherein the protection means includes a surface aerodynamically conformed to the suction surface of the nozzle partition.

4. The nozzle partition as in claim 1, wherein the protection means is disposed over the entire suction side.

5. The nozzle partition as in claim 1, wherein the nozzle partition comprises a first material selected from the martensitic family of 12% chromium stainless steel and the protection means comprises a second material selected from a group consisting of chromium carbide and tungsten carbide.

6. The nozzle partition as in claim 5, wherein the protection means comprises a coating.

7. The nozzle partition as in claim 1, wherein the protection means comprises a coating.

8. The nozzle partition as in claim 7, wherein the coating has a greater resistance to solid particle erosion than does the material constituting said partition.

9. The nozzle partition as in claim 1, wherein the protection means comprises a sheet of material.

10. A pair of nozzle partitions for a steam turbine, one of said pair having an aerodynamically shaped suction surface and including protection means disposed only on the suction surface and extending over at least a portion of the suction surface for preventing solid particle erosion of the one nozzle partition, and the other nozzle partition spaced from the one nozzle partition and having an aerodynamically shaped pressure surface opposing the suction surface, such that the suction surface and pressure surface define a nozzle passageway between the pair of nozzle partitions.

11. The pair of nozzle partitions as in claim 10, wherein the one nozzle partition includes a trailing edge and still further wherein the protection means abuts the trailing edge.

12. The pair of nozzle partitions as in claim 11, wherein the other nozzle partition is further spaced from the one nozzle partition such that a throat is formed in the nozzle passageway, wherein the margins of the throat are defined in part by a respective predetermined portion of the pressure and suction surface, and further wherein the protection means extends over the suction surface between the trailing edge and the portion of the suction side defining in part the throat.

13. The pair of nozzle partitions as in claim 12, wherein the protection means tapers in thickness from the trailing edge to the portion of the suction side defining in part the throat.

14. The pair of nozzle partitions as in claim 13, wherein the protection means includes a surface disposed in the nozzle passageway, the surface being aerodynamically contoured.

15. The pair of nozzle partitions as in claim 12, wherein each nozzle partition comprises a first material independently respectively selected from the martensitic family of 12% chromium stainless steel and the protection means comprises a second material independently respectively selected from a group consisting of chromium carbide and tungsten carbide.

16. The pair of nozzle partitions as in claim 15, wherein the protection means comprises a coating.

17. The pair of nozzle partitions as in claim 10, wherein the protection means comprises a coating.

18. In a steam turbine having a rotor, a stage including a plurality of spaced apart aerodynamically configured nozzle partitions circumferentially surrounding the rotor, at least one of said plurality of nozzle partitions having a pressure surface and a suction surface intersecting at a trailing edge, the at least one of said plurality of nozzle partitions including protection means disposed only on the suction surface and extending over at least a portion of the suction surface for preventing solid particle erosion of the at least one of said plurality of nozzle partitions.

19. The stage as in claim 18, wherein each nozzle partition has a pressure surface and a suction surface intersecting at a trailing edge and each nozzle partition includes respective protection means disposed over at least a portion of the respective suction surface for preventing solid particle erosion of each of said plurality of nozzle partitions.

20. The stage as in claim 19, further including a plurality of buckets and a diaphragm ring circumferentially surrounding the plurality of nozzle partitions, the diaphragm ring having an inner end wall with an end wall surface intersecting each of the plurality of partitions at a respective trailing edge and extending beyond the plurality of nozzle partitions to circumferentially surround the plurality of buckets, the inner end wall including erosion blocking means disposed over the end wall surface.

21. A method for preventing solid particle erosion of a nozzle partition having a suction and a pressure surface intersecting at a trailing edge, said partition disposable in a steam flow path of a steam turbine and said partition subject to an erosive agent impinging the suction surface from a region in the flow path downstream said partition, comprising affixing protection means disposed only on the suction surface and extending over at least a portion of the suction surface.

22. The method as in claim 21, wherein the nozzle partition is disposed axially upstream a plurality of rotatable buckets and the erosive agent impinging the suction surface after striking at least one of the rotatable buckets, further comprising axially separating the nozzle partition and the plurality of buckets a distance adequate to ensure that the erosive agent does not impinge the suction surface after striking at least one of the rotatable buckets.

* * * * *

US004776765B1

REEXAMINATION CERTIFICATE (1732nd)

United States Patent [19]

[11] B1 4,776,765

Sumner et al.

[45] Certificate Issued Jun. 30, 1992

[54] MEANS AND METHOD FOR REDUCING SOLID PARTICLE EROSION IN TURBINES

[75] Inventors: William J. Sumner, Mechanicville; James H. Vogan; Robert J. Lindinger, both of Schenectady, all of N.Y.

[73] Assignee: General Electric Company

Reexamination Request:
No. 90/001,979, Apr. 2, 1990

Reexamination Certificate for:

| | |
|---|---|
| Patent No.: | **4,776,765** |
| Issued: | **Oct. 11, 1988** |
| Appl. No.: | **760,214** |
| Filed: | **Jul. 29, 1985** |

[51] Int. Cl.[5] ..... F01D 5/14
[52] U.S. Cl. ..... 416/241 R; 415/181
[58] Field of Search ..... 415/181, 128, 196, 197, 415/200, 169.1, 169.2, 169.3, 182.1, 191, 121.2; 416/224, 241 R

[56] References Cited

U.S. PATENT DOCUMENTS 4,492,522 1/1985 Rossmann ..... 416/241 R

FOREIGN PATENT DOCUMENTS 59507 5/1979 Japan .
56907 5/1981 Japan .

OTHER PUBLICATIONS

Recent Advances in improving turbine-Generator Availability and Performance by Spencer Mar. 25, 1985.

Doole et al. "Ontario Hydro's Experience with Solid Particle Erosion of Steam Turbines" Published May 6, 1980.

*Primary Examiner*—John T. Kwon

[57] ABSTRACT

Applicants have identified and unexpected mechanism which contributes to solid particle erosion of the trailing edge of spaced apart aerodynamically shaped nozzle partitions in an axial fluid flow turbine. Particles entrained in the fluid flow pass through passages between nozzle partitions, strike rotating buckets and rebound upstream to impinge upon the suction side of the nozzle partitions in the trailing edge region. Accordingly, a nozzle partition includes a protection device disposed over at least a portion of the suction side of the nozzle partition, preferably from the trailing edge to the throat, for preventing solid particle erosion of the partition.

* * * * *

The questions raised in reexamination request No. 90/001,979, filed Apr. 2, 1990 have been considered and the results thereof are reflected in this reissue patent which constitutes the reexamination certificate required by 35 U.S.C. 307 as provided in 37 CFR 1.570(e).

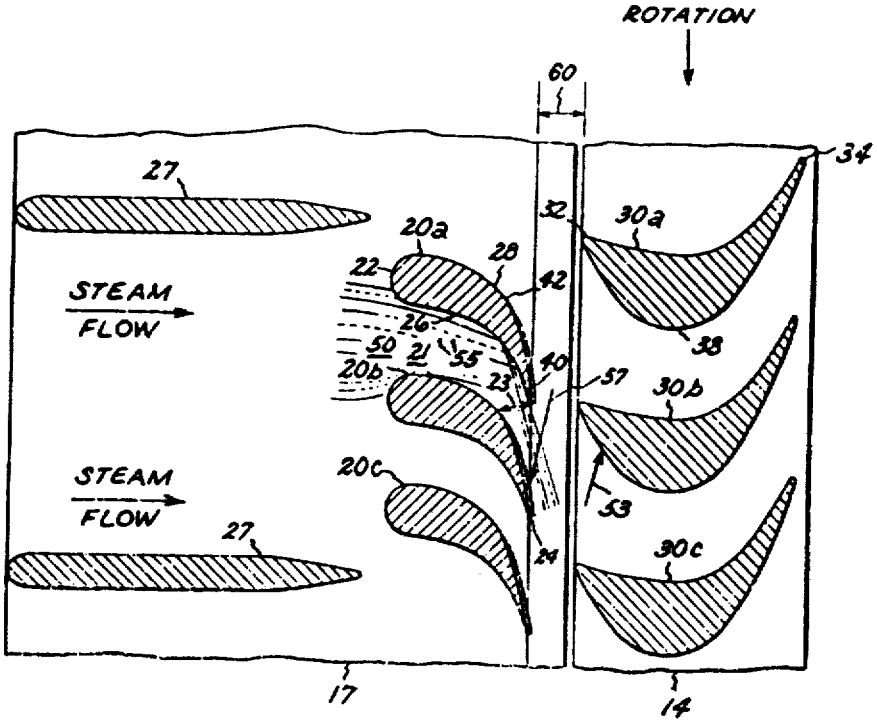

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-22 are cancelled.

* * * * *